US008878883B2

(12) United States Patent
Thayer et al.

(10) Patent No.: US 8,878,883 B2
(45) Date of Patent: Nov. 4, 2014

(54) INKJET PRINTER HAVING AN IMAGE DRUM HEATING AND COOLING SYSTEM

(71) Applicant: Xerox Corporation, Norwalk, CT (US)

(72) Inventors: Bruce E. Thayer, Spencerport, NY (US); Palghat S. Ramesh, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/217,769

(22) Filed: Mar. 18, 2014

(65) Prior Publication Data

US 2014/0198164 A1 Jul. 17, 2014

Related U.S. Application Data

(62) Division of application No. 13/494,653, filed on Jun. 12, 2012, now Pat. No. 8,749,603.

(51) Int. Cl.

| | |
|---|---|
| ***B41J 2/385*** | (2006.01) |
| ***B41J 29/377*** | (2006.01) |
| ***B41J 2/175*** | (2006.01) |
| ***B41J 2/005*** | (2006.01) |
| ***B41J 2/335*** | (2006.01) |

(52) U.S. Cl.

CPC ..... *B41J 2/0057* (2013.01); *B41J 29/377* (2013.01); *B41J 2/17593* (2013.01); *B41J 2/335* (2013.01)

USPC ..... 347/140

(58) Field of Classification Search

USPC ..... 347/133, 140, 171, 194, 205, 206, 209

See application file for complete search history.

(56) References Cited

U.S. PATENT DOCUMENTS

| | | | | |
|---|---|---|---|---|
| 5,099,256 | A | 3/1992 | Anderson | |
| 5,502,476 | A | 3/1996 | Neal et al. | |
| 5,507,227 | A | 4/1996 | Frazer | |
| 5,532,722 | A | 7/1996 | Namiki et al. | |
| 5,982,403 | A * | 11/1999 | Inagaki | 347/140 |
| 6,411,320 | B1 * | 6/2002 | Mcdaniel et al. | 347/140 |
| 6,713,728 | B1 | 3/2004 | Justice et al. | |
| 7,352,380 | B2 | 4/2008 | Takano et al. | |
| 7,459,658 | B2 | 12/2008 | Hays et al. | |
| 7,682,014 | B2 | 3/2010 | Snyder et al. | |
| 7,725,050 | B2 | 5/2010 | Li et al. | |
| 7,860,418 | B2 | 12/2010 | VanKouwenberg et al. | |
| 7,971,987 | B2 | 7/2011 | Godil et al. | |
| 8,529,013 | B2 | 9/2013 | Watt et al. | |
| 2012/0013663 | A1 * | 1/2012 | Snyder et al. | 347/140 |

* cited by examiner

*Primary Examiner* — Kristal Feggins

(74) *Attorney, Agent, or Firm* — Maginot Moore & Beck LLP

(57) ABSTRACT

An inkjet offset printer includes an image receiving drum assembly having a hollow drum with an external surface and an internal surface defining an internal cavity. A heating and a cooling system located in the internal cavity provides distributed heating and cooling to the internal surface of the drum. Heating and cooling can be provided to individual regions of the internal drum surface to maintain a substantially uniform external drum surface temperature.

13 Claims, 7 Drawing Sheets

INKJET PRINTER HAVING AN IMAGE DRUM HEATING AND COOLING SYSTEM

PRIORITY CLAIM

This application claims priority to and is a divisional application of U.S. patent application Ser. No. 13/494,563, which is entitled "Inkjet Printer Having An Image Drum Heating And Cooling System," which was filed on Jun. 12, 2012, and which issued as U.S. Pat. No. 8,749,602 on Jun. 10, 2014.

TECHNICAL FIELD

This disclosure relates generally to solid ink offset printers, and more particularly to rotating image receiving members that are heated to a temperature prior to and while receiving ink images.

BACKGROUND

Inkjet printers operate a plurality of inkjets in each printhead to eject liquid ink onto an image receiving member. The ink can be stored in reservoirs that are located within cartridges installed in the printer. Such ink can be aqueous ink or an ink emulsion. Other inkjet printers receive ink in a solid form and then melt the solid ink to generate liquid ink for ejection onto the image receiving surface. In these solid ink printers, also known as phase change inkjet printers, the solid ink can be in the form of pellets, ink sticks, granules, pastilles, or other shapes. The solid ink pellets or ink sticks are typically placed in an ink loader and delivered through a feed chute or channel to a melting device, which melts the solid ink. The melted ink is then collected in a reservoir and supplied to one or more printheads through a conduit or the like. Other inkjet printers use gel ink. Gel ink is provided in gelatinous form, which is heated to a predetermined temperature to alter the viscosity of the ink so the ink is suitable for ejection by a printhead. Once the melted solid ink or the gel ink is ejected onto the image receiving member, the ink returns to a solid, but malleable form, in the case of melted solid ink, and to a gelatinous state, in the case of gel ink.

A typical inkjet printer uses one or more printheads with each printhead containing an array of individual nozzles through which drops of ink are ejected by inkjets across an open gap to an image receiving surface to form an ink image during printing. The image receiving surface can be the surface of a continuous web of recording media, a series of media sheets, or the surface of an image receiving member, which can be a rotating print drum or endless belt. In an inkjet printhead, individual piezoelectric, thermal, or acoustic actuators generate mechanical forces that expel ink through an aperture, usually called a nozzle, in a faceplate of the printhead. The actuators expel an ink drop in response to an electrical signal, sometimes called a firing signal. The magnitude, or voltage level, of the firing signals affects the amount of ink ejected in an ink drop. The firing signal is generated by a printhead controller with reference to image data. A print engine in an inkjet printer processes the image data to identify the inkjets in the printheads of the printer that are operated to eject a pattern of ink drops at particular locations on the image receiving surface to form an ink image corresponding to the image data. The locations where the ink drops landed are sometimes called "ink drop locations," "ink drop positions," or "pixels." Thus, a printing operation can be viewed as the placement of ink drops on an image receiving surface with reference to electronic image data.

Phase change inkjet printers form images using either a direct or an offset print process. In a direct print process, melted ink is jetted directly onto recording media to form images. In an offset print process, also referred to as an indirect print process, melted ink is jetted onto a surface of a rotating member such as the surface of a rotating drum, belt, or band. Recording media are moved proximate the surface of the rotating member in synchronization with the ink images formed on the surface. The recording media are then pressed against the surface of the rotating member as the media passes through a nip formed between the rotating member and a transfix roller. The ink images are transferred and affixed to the recording media by the pressure in the nip. This process of transferring an image to the media is known as a "transfix" process. The movement of the image media into the nip is synchronized with the movement of the image on the image receiving member so the image is appropriately aligned with and fits within the boundaries of the image media.

When the image receiving member is in the form of a rotating drum, the drum is typically heated to improve compatibility of the rotating drum with the inks deposited on the drum. The rotating drum can be, for example, an anodized and etched aluminum drum. A heater including a heater reflector or housing can be mounted axially within the drum and extends substantially from one end of the drum to the other end of the drum. A heater unit includes one or more heating elements located within the heater reflector with each one being located approximately at each end of the reflector. The heater remains stationary as the drum rotates. Thus, the heaters apply heat to the inside of the drum as the drum moves past the heating elements backed by the reflector. The reflector helps direct the heat towards the inside surface of the drum. Each of the heating elements is operatively connected to a controller which is configured to control the amount of power applied to the heating elements for generating heat. The controller is also operatively connected to temperature sensors located near the outside surface of the drum. The controller selectively operates the heater to maintain the temperature of the outside surface within an operating range.

In one embodiment, the controller is configured to operate the heater in an effort to maintain the temperature at the outside surface of the drum in a range of about 55 degrees Celsius, plus or minus 5 degrees Celsius. The ink that is ejected onto the print drum has a temperature of approximately 110 to approximately 120 degrees Celsius. Thus, images having areas that are densely pixelated, can impart a substantive amount of heat to a portion of the print drum. Additionally, the drum experiences convective heat losses as the exposed surface areas of the drum lose heat as the drum rapidly spins in the air about the heater. Also, contact of the recording media with the print drum affects the surface temperature of the drum. For example, paper placed in a supply tray has a temperature roughly equal to the temperature of the ambient air. As the paper is retrieved from the supply tray, it moves along a path towards the transfer nip. In some printers, this path includes a media pre-heater that raises the temperature of the media before it reaches the drum. These temperatures can be approximately 40 degrees Celsius. Thus, when the media enters the transfer nip, areas of the print drum having relatively few drops of ink on them are exposed to the cooler temperature of the media. Consequently, densely pixilated areas of the print drum are likely to increase in temperature, while more sparsely covered areas are likely to lose heat to the passing media. These differences in temperatures result in thermal gradients across the print drum.

Transfer defects can occur if the drum temperature exceeds about 62° C. When the thermistors measure a drum surface temperature of 57-58° C., the fan is turned on to start cooling the drum. When the thermistors measure a drum temperature that is too low, the heater is turned on until the thermistor measurements are within the control band of acceptable temperature. Hot ink jetted onto the drum surface increases the temperature of the drum in areas of high ink density. In areas without ink, the print media tends to cool the drum surface. Long printing jobs with prints containing areas of high ink density on one portion of the print and other areas of the print with little or no ink can create significant temperature differences between the ink and no ink locations on the drum. With temperature sensing only at the ends of the drum, detection of a temperature difference can be difficult if detected at all. If the temperature difference is detected, then a single fan and dual circuit heater can be incapable of correcting the temperature difference before image quality defects result. The thick walls of the drum can include a large mass of aluminum which cannot be rapidly heated or rapidly cooled. The large mass can help to prevent the generation of an image defect caused by temperature differences. If large temperature differences do occur, however, a reduction in the temperature difference can be made too slowly by the heater or fan to avoid defects.

Efforts have been made to control the thermal gradients across a print drum for the purpose of maintaining the surface temperature of the print drum within the operating range. Simply turning the heater on and off can be insufficient because the ejected ink can raise the surface temperature of the print drum above the operating range, even when an individual heating element is turned off. In some cases cooling is provided by adding a fan at one end of a print drum. The print drum is open at each flat end of the drum. To provide cooling, the fan is located outside the print drum and is oriented to blow air from the end of the drum at which the fan is located to the other end of the drum where it is exhausted. The fan is electrically operatively connected to the controller so the controller activates the fan in response to one of the temperature sensors detecting a temperature exceeding the operating range of the print drum. The air flow from the fan eventually cools the overheated portion of the print drum at which point the controller deactivates the fan.

While the fan system described above can generally maintain the temperature of the drum within an operating range, some inefficiencies do exist. Specifically, one inefficiency can arise when the surface area at the end of the print drum from which the air flow is exhausted has a higher temperature than the surface area near the end of the print drum at which the fan is mounted. In response to the detection of the higher temperature, the controller activates the fan. As the cooler air enters the drum, it absorbs heat from the area near the fan that is within the operating range. This cooling can result in the controller turning on the heater for that region to keep that area from falling below the operating range. Even though the air flow is heated by the region near the fan and/or the heating element in that area, the air flow can eventually cool the overheated area near the drum end from which the air flow is exhausted. Nevertheless, the energy spent warming the region near the fan and the additional time required to cool the overheated area with the warmed air flow from the fan adds to the operating cost of the printer. Thus, improvements to printers to heat and to cool a print drum are desirable.

The transfix solid ink printing process requires that the image drum surface be maintained within a relatively narrow temperature range. If the temperature is too low, the ink image will not spread under pressure in the transfix nip. If the temperature is too high, transfer from the image drum to print media will be poor. Conventional systems use a heater and a cooling fan to adjust the drum temperature based on thermistor temperature readings outside of the print area on the inboard and outboard ends of the drum. Drum temperature uniformity is influenced by media size, weight and mix, image density and distribution on the prints, and job length. Low area coverage prints cool the drum and high area coverage prints heat the drum in the location of the ink. The resulting temperature gradients on the drum surface can be large enough to generate local defects due to high or low temperatures. Thinner drums are desirable for cost and drive torque, but are more susceptible to temperature gradients due to lower mass. Thicker drums are less susceptible to temperature gradients, but also take longer to heat or cool due to higher mass. It is also desired to increase the diameter of the drum for production applications of solid ink jet printers to increase printer throughput. Larger drums, however, generally require thicker drums for mechanical strength which can increase the occurrence of temperature gradients. The temperature difference problems can also be more prevalent in larger systems used for printing many copies of the same documents, because many ink images can be expected to be the same or similar in long production jobs which can increase the likelihood of localized heating on the drum.

SUMMARY

A heated drum assembly for use in a printer includes a heating and cooling system disposed within an imaging drum to control the temperature of an external surface of the imaging drum. The heated drum assembly includes a hollow drum having an external surface and an internal surface defining an internal cavity. The hollow drum includes a first end, a second end, and a longitudinal axis. A heater located in the internal cavity includes three or more heating units, each of the heating units is individually controllable to heat three or more zones defined on the external surface of the hollow drum along a longitudinal axis selectively. A controller is operatively connected to the heater and the controller is configured to regulate an amount of heat generated by each of the three or more heating units of the heater.

A printer includes an image receiving member and a heating and cooling system disposed within the image receiving member. The image receiving member includes a substantially cylindrical outer surface and an internal surface defining an internal cavity. A heater located in the internal cavity includes three or more heating units, wherein each of the heating units is individually controllable to selectively heat three or more zones defined on the image receiving member. A printhead deposits ink on the image receiving member and is disposed adjacent to the image receiving member. A controller is operatively connected to the heater and is configured to control the amount of heat provided by each of the plurality of heating units.

BRIEF DESCRIPTION OF THE DRAWINGS

The foregoing aspects and other features of an inkjet printer having a rotating image drum with axial distribution of temperature sensing, heating, and cooling to provide selective control of drum surface temperatures are explained in the following description, taken in connection with the accompanying drawings.

DETAILED DESCRIPTION

Figure 1:
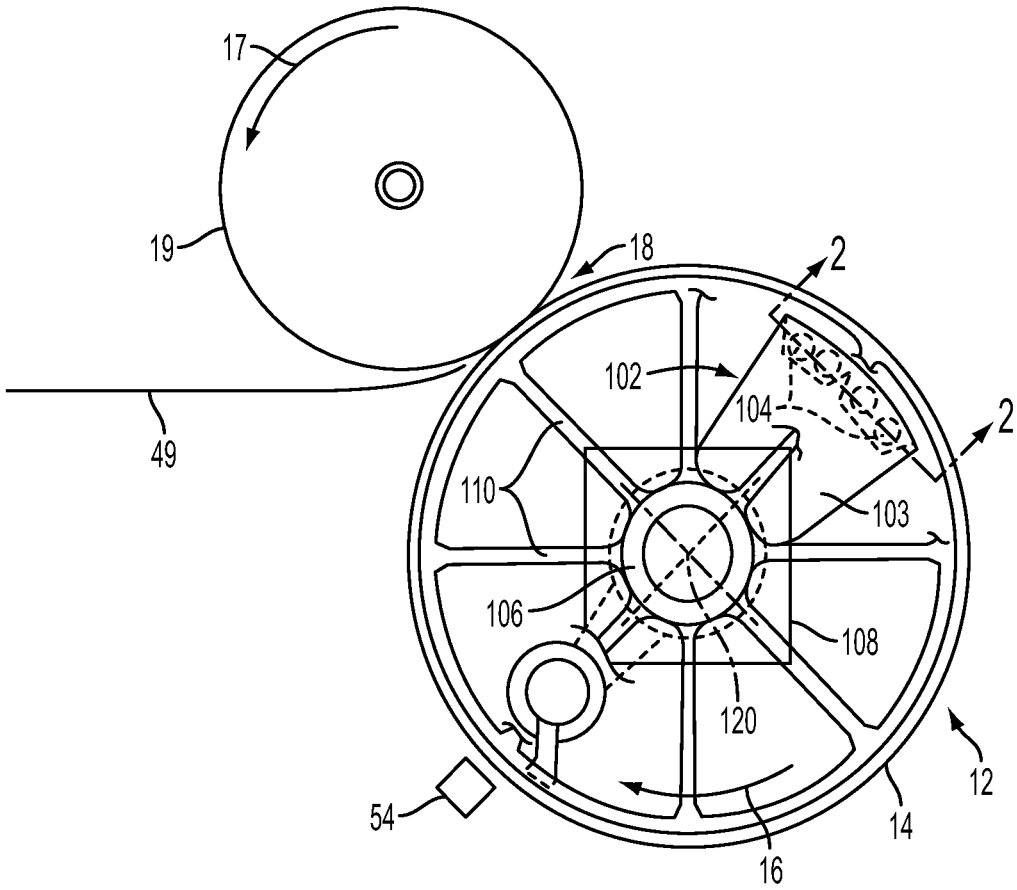
FIG. 1 is a side view of a portion of a printer including a transfix roller defining a nip with an image receiving member.

For a general understanding of the environment for the system and method disclosed herein as well as the details for the system and method, reference is made to the drawings. In the drawings, like reference numerals have been used throughout to designate like elements. As used herein the term "printer" refers to any device that produces ink images on media and includes, but is not limited to, photocopiers, facsimile machines, multifunction devices, as well as direct and indirect inkjet printers. An image receiving surface refers to any surface that receives ink drops, such as an imaging drum, imaging belt, or various recording media including paper.

Figure 10:
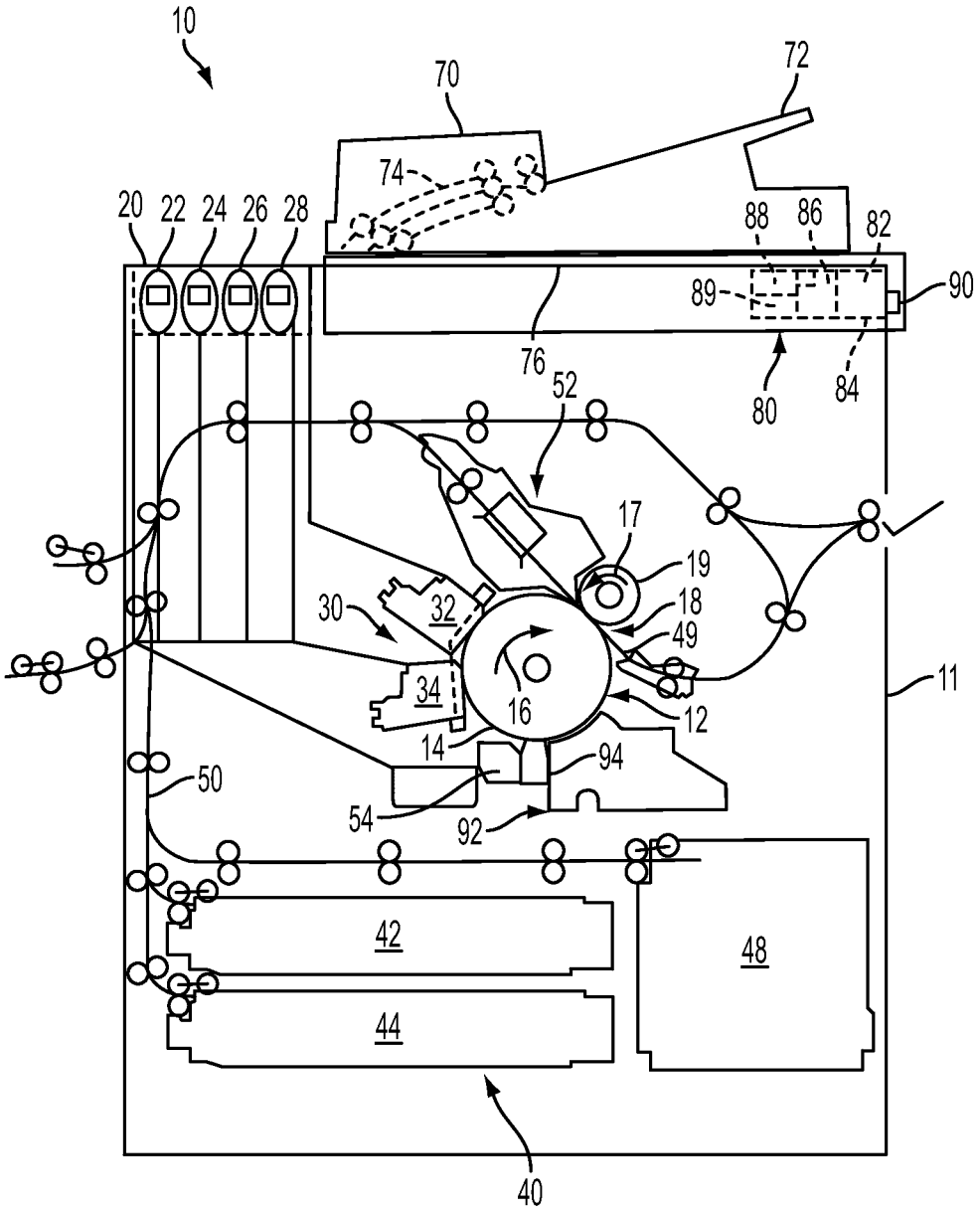
FIG. 10 PRIOR ART
FIG. 10 is a schematic view of an inkjet printer configured to print images onto a rotating image receiving member and to transfer the images to recording media.

FIG. 10 illustrates a prior art high-speed phase change ink image producing machine or printer 10. As illustrated, the printer 10 includes a frame 11 supporting directly or indirectly operating subsystems and components, as described below. The printer 10 includes an image receiving member 12 that is shown in the form of a drum, but can also include a supported endless belt. The image receiving member 12 has an imaging surface 14 that is movable in a direction 16, and on which phase change ink images are formed. A transfix roller 19 rotatable in the direction 17 is loaded against the surface 14 of drum 12 to form a transfix nip 18, within which ink images formed on the surface 14 are transfixed onto a recording media 49, such as heated media sheet.

The high-speed phase change ink printer 10 also includes a phase change ink delivery subsystem 20 that has at least one source 22 of one color phase change ink in solid form. Since the phase change ink printer 10 is a multicolor image producing machine, the ink delivery system 20 includes four (4) sources 22, 24, 26, 28, representing four (4) different colors CYMK (cyan, yellow, magenta, black) of phase change inks. The phase change ink delivery system also includes a melting and control apparatus (not shown) for melting or phase changing the solid form of the phase change ink into a liquid form. The phase change ink delivery system is suitable for supplying the liquid form to a printhead system 30 including at least one printhead assembly 32. Each printhead assembly 32 includes at least one printhead configured to eject ink drops onto the surface 14 of the image receiving member 12 to produce an ink image thereon. Since the phase change ink printer 10 is a high-speed, or high throughput, multicolor image producing machine, the printhead system 30 includes multicolor ink printhead assemblies and a plural number (e.g., two (2)) of separate printhead assemblies 32 and 34 as shown, although the number of separate printhead assemblies can be one or any number greater than two.

As further shown, the phase change ink printer 10 includes a recording media supply and handling system 40, also known as a media transport. The recording media supply and handling system 40, for example, can include sheet or substrate supply sources 42, 44, 48, of which supply source 48, for example, is a high capacity paper supply or feeder for storing and supplying image receiving substrates in the form of cut media sheets 49, for example. The recording media supply and handling system 40 also includes a substrate handling and treatment system 50 that has a substrate heater or pre-heater assembly 52. The phase change ink printer 10 as shown can also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 is operably connected to the image receiving member 12, the printhead assemblies 32, 34 (and thus the printheads), and the substrate supply and handling system 40. The ESS or controller 80, for example, is a self-contained, dedicated mini-computer having a central processor unit (CPU) 82 with electronic storage 84, and a display or user interface (UI) 86. A temperature sensor 54 is operatively connected to the controller 80. The temperature sensor 54 is configured to measure the temperature of the image receiving member surface 14 as the image receiving member 12 rotates past the temperature sensor 54. In one embodiment, the temperature sensor is a thermistor that is configured to measure the temperature of a selected portion of the image receiving member 12. The controller 80 receives data from the temperature sensor and is configured to identify the temperatures of one or more portions of the surface 14 of the image receiving member 12.

The ESS or controller 80, for example, includes a sensor input and control circuit 88 as well as a pixel placement and control circuit 89. In addition, the CPU 82 reads, captures, prepares and manages the image data flow between image input sources, such as the scanning system 76, or an online or a work station connection 90, and the printhead assemblies 32 and 34. As such, the ESS or controller 80 is the main multitasking processor for operating and controlling all of the other machine subsystems and functions, including the printing process discussed below.

The controller 80 can be implemented with general or specialized programmable processors that execute programmed instructions. The instructions and data required to perform the programmed functions can be stored in memory associated with the processors or controllers. The processors, associated memories, and interface circuitry configure the controllers to perform the processes that enable the printer to perform heating of the image receiving member, depositing of the ink, and DMU cycles. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

In operation, image data for an image to be produced are sent to the controller 80 from either the scanning system 76 or via the online or work station connection 90 for processing and output to the printhead assemblies 32 and 34. Additionally, the controller 80 determines and/or accepts related subsystem and component controls, for example, from operator inputs via the user interface 86, and accordingly executes such controls. As a result, appropriate color solid forms of phase change ink are melted and delivered to the printhead assemblies 32 and 34. Additionally, pixel placement control is exercised relative to the imaging surface 14 thus forming desired images per such image data, and receiving substrates, which can be in the form of media sheets 49, are supplied by any one of the sources 42, 44, 48 and handled by recording media system 50 in timed registration with image formation on the surface 14. Finally, the image is transferred from the surface 14 and fixedly fused to the image substrate within the transfix nip 18.

In some printing operations, a single ink image can cover the entire surface of the imaging member 12 (single pitch) or a plurality of ink images can be deposited on the imaging member 12 (multi-pitch). Furthermore, the ink images can be deposited in a single pass (single pass method), or the images can be deposited in a plurality of passes (multi-pass method). When images are deposited on the image receiving member 12 according to the multi-pass method, under control of the controller 80, a portion of the image is deposited by the printheads within the printhead assemblies 32, 34 during a first rotation of the image receiving member 12. Then during one or more subsequent rotations of the image receiving member 12, under control of the controller 80, the printheads deposit the remaining portions of the image above or adjacent to the first portion printed. Thus, the complete image is printed one portion at a time above or adjacent to each other during each rotation of the image receiving member 12. For example, one type of a multi-pass printing architecture is used to accumulate images from multiple color separations. On each rotation of the image receiving member 12, ink droplets for one of the color separations are ejected from the printheads and deposited on the surface of the image receiving member 12 until the last color separation is deposited to complete the image.

In some cases for example, cases in which secondary or tertiary colors are used, one ink droplet or pixel can be placed on top of another one, as in a stack. Another type of multi-pass printing architecture is used to accumulate images from multiple swaths of ink droplets ejected from the print heads. On each rotation of the image receiving member 12, ink droplets for one of the swaths (each containing a combination of all of the colors) are applied to the surface of the image receiving member 12 until the last swath is applied to complete the ink image. Both of these examples of multi-pass architectures perform what is commonly known as "page printing." Each image comprised of the various component images represents a full sheet of information worth of ink droplets which, as described below, is then transferred from the image receiving member 12 to a recording medium.

In a multi-pitch printing architecture, the surface of the image receiving member is partitioned into multiple segments, each segment including a full page image (i.e., a single pitch) and an interpanel zone or space. For example, a two pitch image receiving member 12 is capable of containing two images, each corresponding to a single sheet of recording medium, during a revolution of the image receiving member 12. Likewise, for example, a three pitch intermediate transfer drum is capable of containing three images, each corresponding to a single sheet of recording medium, during a pass or revolution of the image receiving member 12.

Once an image or images have been printed on the image receiving member 12 under control of the controller 80 in accordance with an imaging method, such as the single pass method or the multi-pass method, the exemplary inkjet printer 10 converts to a process for transferring and fixing the image or images at the transfix roller 19 from the image receiving member 12 onto a recording medium 49. According to this process, a sheet of recording medium 49 is transported by a transport under control of the controller 80 to a position adjacent the transfix roller 19 and then through a nip formed between the movable or positionable transfix roller 19 and image receiving member 12. The transfix roller 19 applies pressure against the back side of the recording medium 49 in order to press the front side of the recording medium 49 against the image receiving member 12. In some embodiments, the transfix roller 19 can be heated.

A pre-heater for the recording medium 49 is provided in the media path leading to the nip. The pre-heater provides the necessary heat to the recording medium 49 for subsequent aid in transfixing the image thereto, thus simplifying the design of the transfix roller. The pressure produced by the transfix roller 19 on the back side of the heated recording medium 49 facilitates the transfixing (transfer and fusing) of the image from the image receiving member 12 onto the recording medium 49.

The rotation or rolling of both the image receiving member 12 and transfix roller 19 not only transfixes the images onto the recording medium 49, but also assists in transporting the recording medium 49 through the nip formed between them. Once an image is transferred from the image receiving member 12 and transfixed to a recording medium 49, the transfix roller 19 is moved away from the image receiving member 12. The image receiving member 12 continues to rotate and, under the control of the controller 80, any residual ink left on the image receiving member 12 is removed by drum maintenance procedures performed at a drum maintenance unit (DMU) 92.

The DMU 92 can include a release agent applicator 94, a metering blade, and, in some embodiments, a cleaning blade. The release agent applicator 94 can further include a reservoir having a fixed volume of release agent such as, for example, silicone oil, and a resilient donor roll, which can be smooth or porous and is rotatably mounted in the reservoir for contact with the release agent and the metering blade. The DMU 92 is operably connected to the controller 80 such that the donor roll, metering blade and cleaning blade are selectively moved by the controller 80 into temporary contact with the rotating image receiving member 12 to deposit and distribute release agent onto and remove un-transferred ink pixels from the surface of the member 12.

The primary function of the release agent is to prevent the ink from adhering to the image receiving member 12 during transfixing when the ink is being transferred to the recording medium 49. The release agent also aids in the protection of the transfix roller 19. Small amounts of the release agent are transferred to the transfix roller 19 and this small amount of release agent helps prevent ink from adhering to the transfix roller 19. Consequently, a minimal amount of release agent on the transfix roller 19 is acceptable.

The image receiving member 12 has a tightly controlled surface that provides a microscopic reservoir capacity to hold the release agent. Too little release agent present in areas or over the entire image receiving member prevents transfer of the ink pixels to the recording media 49. Conversely, too much release agent present on the image receiving member 12 results in transfer of some release agent to the back side of the recording media 49. If the recording media 49 is then printed on both sides in duplex printing, some of the ink pixels may not adhere properly to the second side of the recording media 49. To combat these image defects, each DMU cycle selectively applies and meters release agent onto the surface of the image receiving member 12 by bringing the donor roller and then the metering blade of the release agent applicator 94 into contact with the surface of the image receiving member 12 prior to subsequent printing of images on the image receiving member 12 by the printheads in assemblies 32, 34. These actions replenish the release agent to the reservoir on the surface of the image receiving member 12 to prevent image failure and ensure continued application of a uniform layer of release agent to the surface of the image receiving member 12.

FIG. 1 is a side view of a portion of the printer 10 including the image receiving member 12, with the imaging surface 14 rotating in the direction 16, and the transfix roller 19 rotating in the direction 17. In this embodiment, the image receiving member 12 includes a heater 102 having a reflector 103 into which one or more heating elements 104 are mounted. The heater 102 remains fixed as drum 12 rotates past the heater 102. The heater 102 generates heat that is absorbed by the inside surface of the drum 12 to heat the image receiving surface 14 of the drum as it rotates past the heater. A cooling system for the drum 12 includes a hub 106 that is preferably centered about the longitudinal center line of the image receiving member 12. A fan 108 is mounted outboard of the hub 106 and oriented to direct air flow through the drum. A plurality of temperature sensors, one of which is illustrated in FIG. 1 as temperature sensor 54, are located proximate the outer surface 14 of the drum 12 to detect the temperature of the drum surface as it rotates. See FIG. 6 and the related description for details of the additional temperature sensors. The temperature sensors are preferably mounted in a linear arrangement parallel to the longitudinal axis 120.

Each end of the drum 12 can be open and supported by the hub 106 and a plurality of spokes 110 as shown in FIG. 1. The hub 106 can be provided with a pass through for passage of electrical wires to the heater(s) within the drum. Additionally, the hub 106 has a bearing at its center or axis 120 so the drum can be rotatably mounted in a printer. The spokes 110 extend from the hub 106 to support the cylindrical wall of the drum 12 and to provide airways for air circulation within the drum 12. The heater 102 that heats the drum 12 can be a convective or radiant heater.

The fan 108 can be a muffin fan or other conventional electrical fan. The fan 108 can also be a DC fan or a bi-directional fan. A bi-directional fan is one that can push or pull an air flow in response to an activation signal and a direction signal. The direction of fan blade rotation in a DC fan depends upon the polarity of the DC power source applied to the fan. Thus, a DC fan can be made to blow air in one direction or the other by controlling the polarity of the source voltage to the fan. In one embodiment, the fan 108 can produce air flow in the range of approximately 45-55 cubic feet per minute (CFM) of air flow, although other airflow ranges can be used depending upon the thermal parameters of a particular application. The temperature sensor 54, and the other sensors described herein, can be any type of a temperature sensing device that generates an analog or digital signal indicative of a temperature in the vicinity of the sensor. Such sensors include, for example, thermistors or other junction devices that predictably change an electrical property in response to the absorption of heat. Other types of sensors include dissimilar metals that bend or move as the materials having different coefficients of temperature expansion respond to heat.

Figure 2:
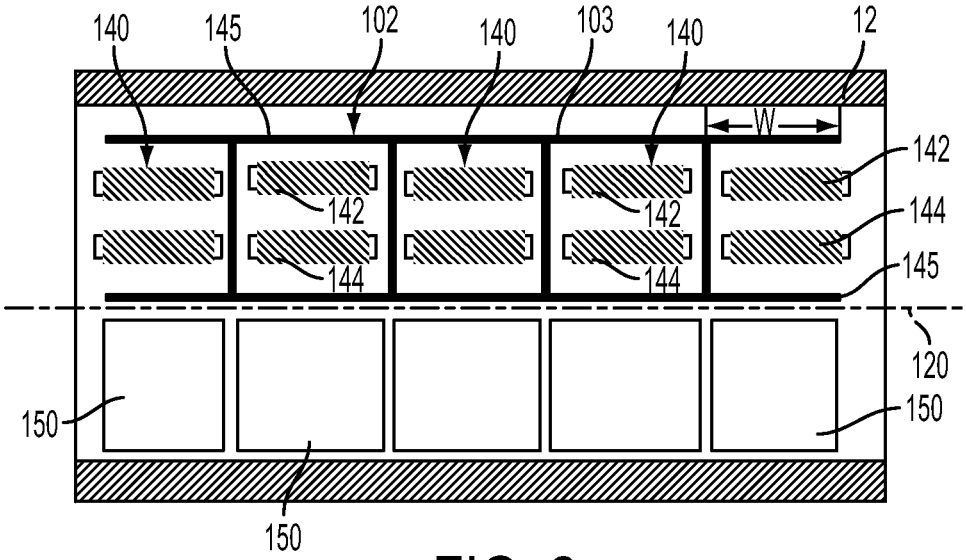
FIG. 2 is a partial sectional view of the image receiving member illustrating a heater disposed in the image receiving member of FIG. 1 along a line 2-2.

A partial sectional view of the drum 12 along the line 2-2 of FIG. 1 is shown in FIG. 2 to illustrate the heater 102. To reduce or prevent the temperature difference problems described above, the heater 102 includes a plurality of individual heater units 140 each of which includes a first heating element 142 and a second heating element 144. Each heating element 142 and 144 is typically a heating coil, although heating elements other than coils can be used, such as lamps. Although two heating elements are shown in each heater unit, there could be only one heating element or more than two heating elements in each heater unit. Five heater units 140 are illustrated in FIG. 2 each having an edge aligned along a plane extending from the longitudinal axis 120 of the drum 12. Each of the heater units 140 includes a width W disposed such that each heating unit defines a band 146. (See FIG. 3) The band 146 includes the width, W, wherein the heat received within a band can be controlled by the state of a respective heater unit 140. For instance, if the leftmost illustrated heating elements 142 of FIG. 2 are turned off, a corresponding band 146A of the drum 12 would not receive heat (See FIG. 3). If the heating elements of a heating unit 140 adjacent to the leftmost illustrated heating unit 140 are turned on, heat is applied to the adjacent band 146B of FIG. 3.

The bands 146 circumscribe a longitudinal circumference of the drum 12 since the heater 102 remains stationary during rotation of the drum 12. Each of the heating units 140 includes an individual reflector 145 having sidewalls to direct the generated heat through an aperture or opening defined by the sidewalls to the internal surface of the drum. The heating units 140, while being shown as axially oriented, can also be oriented in a circumferential arc that closely follows the inner surface of the drum.

Use of segmented heater units distributed along the length of the drum provides for longitudinal control of drum heating. Due to the inherently slow response time of a typical heater element, partial circumferential control of drum heating at a specific location within a band can be less precise. While turning the heater elements on and off can provide for application of heat to portions of a longitudinal band, the slow response time of a typical heater element can prevent the application of heat to distinctly defined portions of the band.

To provide for the application of heat to a specific portion of a band, the heater 102 can include a plurality of shutters, or covers, 150, each of which is individually controllable to open and to close the aperture and to either expose the heating elements of a heater unit 140 or to cover the heating elements of a heater unit 140. As can be seen in FIG. 2, each of the heating units 140 is exposed and the corresponding shutter 150 is positioned adjacently to one of the respective heating units 140 in a first position. In a second position, the shutters cover the heating elements 142 and 144 of an adjacent heating unit 140. Consequently, the slow response time of heater element can be compensated for by the use of the shutter between the heater elements and the internal surface of the drum 102. Each of the shutters includes a reflective surface which disposed adjacent to the heater elements when the shutter is positioned to block the heat being generated by the heater unit. Heat transfer between the heating elements and the internal surface of the drum is thereby reduced until the shutter is opened.

Figure 4:
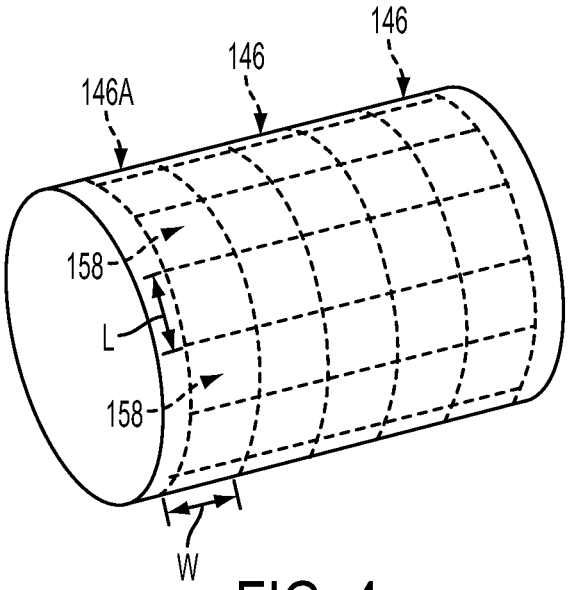
FIG. 4 is a schematic view of a plurality of circumferential zones defined on the image receiving member of FIG. 1.

The shutter mechanism provides longitudinal and circumferential control of heating as illustrated in FIG. 4. The longitudinal bands 146 can be segmented or portioned into individual heating zones 158. The size of the circumferential heating control zone is dependent on the speed of the shutter and the speed of the drum. Each of the zones 158 includes a width, W, as previously described, and a length L. The length L can be determined by the amount of time the shutter covers the respective heater unit 140 and the rotating speed of the drum. Heater shutters can also reduce the amount of time required to warm-up heater elements. The shutter can be closed for a predetermined amount of time to prevent heat escape from the heater unit. When the coils reach or are near the defined temperature, the shutters open to radiate heat to the internal surface of the drum.

Figure 5:
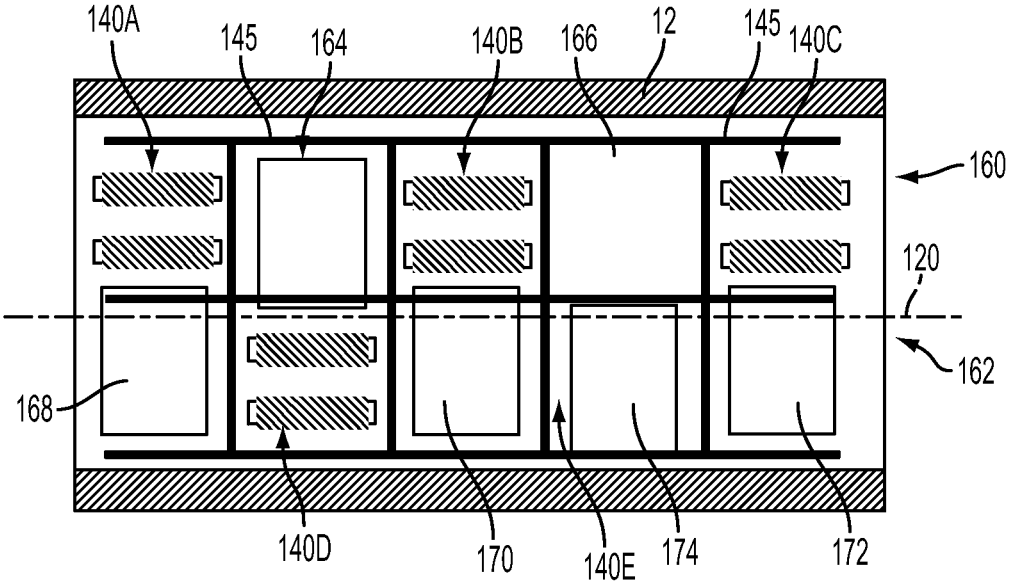
FIG. 5 is a partial sectional view of another embodiment of the heater disposed in the image receiving member.

FIG. 5 illustrates another embodiment of the heater 102 including heater units 140 having sides disposed along a plane extending from the longitudinal axis 120 of the drum 12 in a first row 160 and a second row 162. The first row 160 includes first, second, and third heating units 140A, 140B, and 140C. Heating unit 140A is separated from second heating unit 140B by a shutter unit 164. Second heating unit 140B is separated from third heating unit 140C by a shutter unit 166. While the heating units and shutter units are alternately located, other configurations are possible.

The second row 162 includes shutter units 168, 170, and 172 wherein heating unit 140D is located between shutter units 168 and 170, and heating unit 140E is located between shutter units 170 and 172. The heating elements of heating unit 140E are not illustrated, since a shutter 174 from shutter unit 166 is positioned in heating unit 140E to block or substantially limit heat transmission from heating unit 140E to the internal surface of the drum 12.

Figure 3:
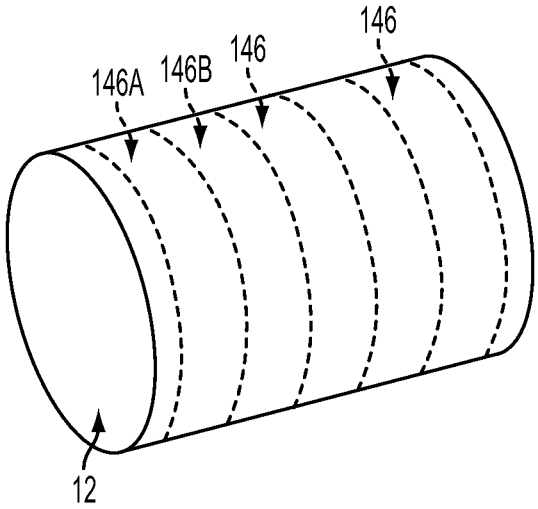
FIG. 3 is a schematic view of a plurality of longitudinal zones defined on the image receiving member of FIG. 1.
Figure 6:
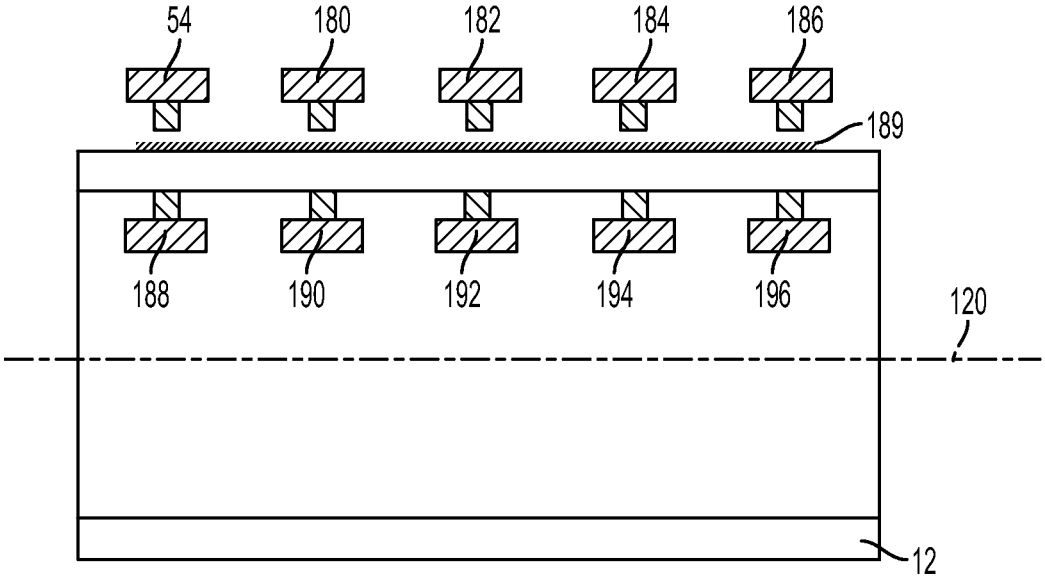
FIG. 6 is a schematic section view of a plurality of external and internal temperature sensors disposed at an image receiving member.

A plurality of individual temperature sensors are disposed externally and/or internally to the drum 12 to sense the temperature along each of the bands 146 of FIGS. 3 and 4. In addition to temperature sensor 54, additional temperature sensors 180, 182, 184, and 186 are disposed externally to the drum 12 as illustrated in FIG. 6. The sensors 54, 180, 182, 184, and 186 are non-contact sensors and are spaced from the external surface of the drum 12 because the external surface of the drum receives ink in an imaging area 189 which can be disturbed by a contact sensor. Contact sensors can also wear the drum surface which can cause image defects. The non-contact sensors can be infrared sensors or other types of temperature sensors spaced close to the drum surface, but not in a contacting relationship. Certain types of infrared sensors can be spaced further away from the drum surface, but such types of sensors can be expensive. Lower cost sensors can be used but can be spaced closer to the drum surface. Signals generated by such lower cost signals can require compensation through heat transfer calculations to account for the air gap to the drum and temperature response time of the sensor.

A plurality of individual temperature sensors 188, 190, 192, 194, and 196 are disposed internally to the drum 12 to sense the temperature along each of the bands 146 of FIGS. 3 and 4. Thermistors or other contact sensors can be used on the inside surface of the drum since wear to the internal surface of the drum is immaterial. Non-contact temperature sensors can be also be used on the inside surface of the drum. Because a certain amount of time is required for heat to conduct through the thickness of the drum wall, a temperature measurement on the internal surface of the drum and a temperature measurement at the external surface of the drum can be different. However, outer drum surface temperatures can be measured with internal sensors by taking into account thermal conduction through the image drum thickness and conduction to and from adjacent control zones. In addition, internal temperatures can be affected by other conditions within the drum and should be taken into account when calculating an internal temperature. These temperature effects can be accounted for through heat transfer calculations. The signals from the external and internal temperature sensors can be analog signals that are digitized by an A/D converter, which is interfaced to the controller 80. The controller 80 receives temperature values from the temperature sensors and provides control signals to the heater units and the shutters for control of the applied heat.

Both internal and external sensors can provide temperature information in longitudinal and circumferential regions. The number of longitudinal regions is dependent on the number of sensors distributed along the length of the drum. If a sensor is not located to define a particular band, the temperature of the band cannot be accurately measured and controlled. Alternatively, the number of sensors can be less than the number of longitudinal regions if the drum temperature in each longitudinal region is determined based on the sensor temperature information of a neighboring region and heat transfer calculations. This requires knowledge of the heat input to each region from jetted ink images, which are determined from the known image content. Also required are heating and cooling inputs from the heater units and cooling air flow. The number of circumferential regions can be selected based on the response time of the sensors and the rotational speed and thickness of the drum. Temperature differences in the circumferential direction are more significant when print images are repeatedly placed in the same locations on the drum surface. For printing with spacings between the images that allow the images on the drum to precess along the drum circumference, over a long print run, the temperature nonuniformity in the circumferential direction can be less significant. As the drum thickness decreases, the possibility of temperature differences large enough to cause print defects becomes greater and drum surface temperature measurement from the drum interior becomes simpler.

Figure 7:
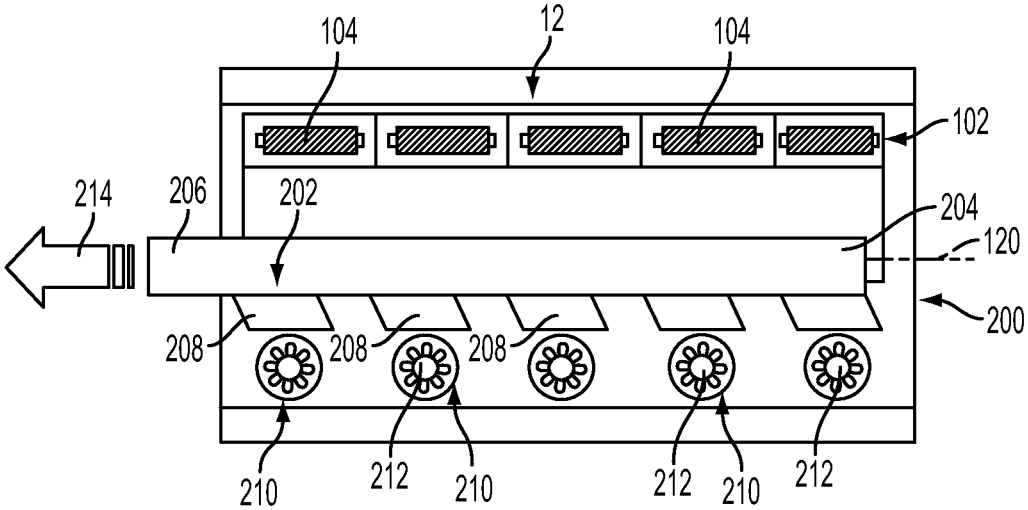
FIG. 7 is a partial schematic view of a heater and a cooling system disposed in an image receiving member.

FIG. 7 illustrates one embodiment of drum 12 including a cooling system 200 and the heater 102. The cooling system 200 includes a centrally disposed conduit 202 which is supported along the central axis of the drum 120 by the hub 106 of FIG. 1. The conduit 202 has a first end 204, which is closed, and a second end 206, which is open. The conduit 202 defines a cylinder or channel having an internal space, wherein the cylinder includes a plurality of openings each of which is operatively connected to a branch 208. Each of the branches 208 are operatively connected to a fan 210, each of which includes a fan blade 212 to exhaust air within the vicinity of the fan 210 through a respective branch 208, though the internal space of the conduit 202, and externally from the drum 12 through the second end 206.

In this embodiment, the drum 12 is sufficiently large to provide for the distribution of a plurality small fans 210 along the length of the drum 12. Each fan 210 can be supported by a structure (not shown) extending from the conduit 202 or by an additional structure supported by the hub 106 (not shown). The fans 210 remain stationary with respect to the rotating drum 12 and can be positioned a predetermined distance from the internal surface of the drum depending on the air flow capacity of the fan 210 and the rotational speed of the drum 12. Each fan 210 can be turned on individually to exhaust heated air from the internal surface of the drum and out the conduit 202 in a direction 214. The fans can be turned on and off rapidly by the controller 80 which is configured to adjust the amount of heat at the longitudinal and circumferential cooling zones of FIG. 4. In another embodiment, the blades 212 of fans 210 can direct cooling air to the surface of the drum.

Figure 8:
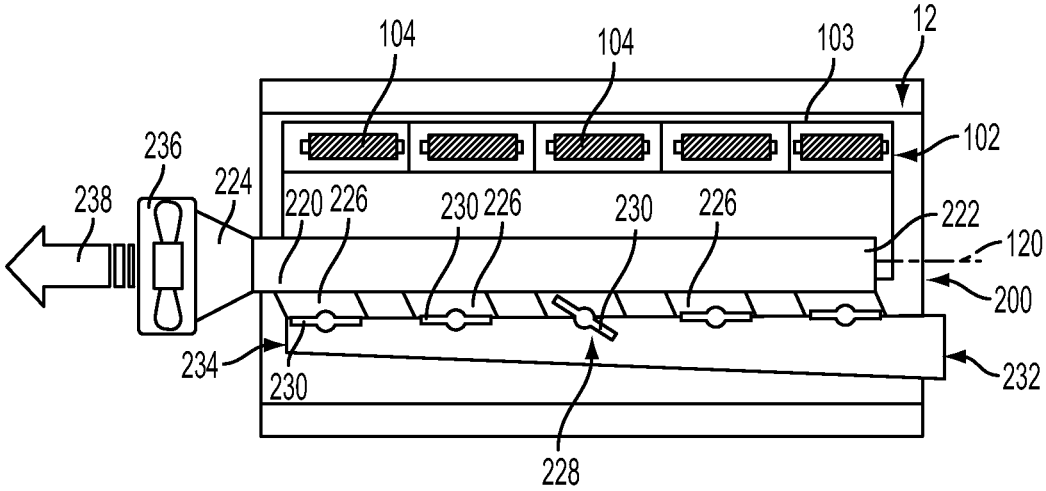
FIG. 8 is a partial schematic view of another embodiment of a heater and a cooling system disposed in an image receiving member.

In an embodiment as illustrated in FIG. 8, the cooling system 200 includes a trunk 220 centrally disposed within the drum 12 and supported along the central axis of the drum 120 by the hub 106. The trunk 220 includes a first end 222, which is closed, and a second end 224, which is open. The trunk defines a cylinder having an internal space, wherein the cylinder includes a plurality of openings each of which is operatively connected to a respective branch 226. Each of the branches 226 is operatively connected to a duct 228. A plurality of valves 230 are operatively connected to the duct 228, each valve 230 being located at the intersection of a branch 226 with the duct 228. The duct includes an open end 232 and a closed end 234. A fan 236 is operatively connected to the end 224 and directs air flow in the direction 238. The duct 228 includes a plurality of openings, slots, or nozzles, (not shown) with each opening being associated with one of the valves 230. Cooler air located externally to the drum 12 is drawn by the fan 236 through the open end 232 and through the slots to decrease the temperatures at selected locations in the longitudinal and circumferential zones, where the appropriate zone is selected by the location and position of the valves 230.

Each of the valves 230 is operatively connected to the controller 80 which controls not only the position of the valve, but also the amount of time the valve is in an open and a closed position. In this way, not only can a longitudinal zone be selected for cooling but a portion of the longitudinal zone, the circumferential zone, can also be cooled. By applying the described exhaust air ducting, air flow is exhausted from the slots to provide cooling of adjacent zones. High speed operation of the valves allows cooling of relatively small circumferential zones on even high speed drums.

Figure 9:
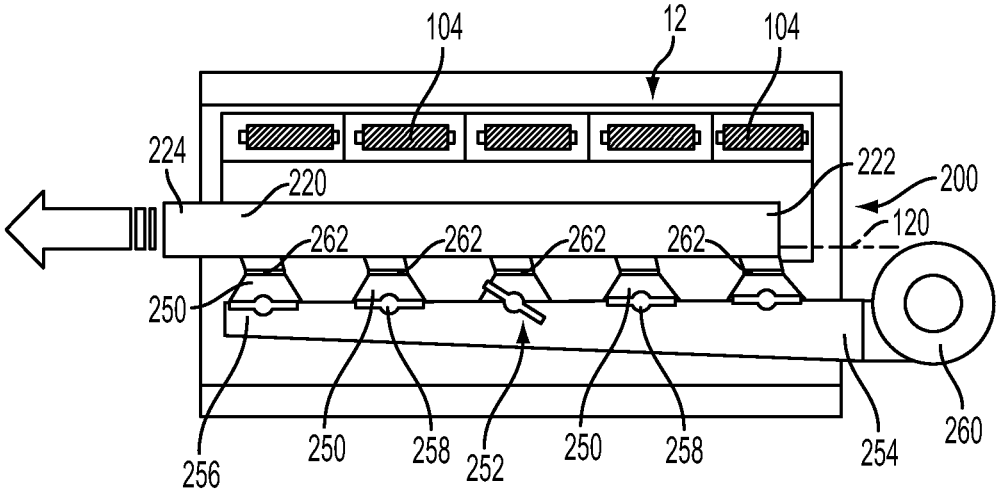
FIG. 9 is a partial schematic view of another embodiment of a heater and a cooling system disposed in an image receiving member.

FIG. 9 illustrates another embodiment of the cooling system 200 which includes the trunk 220 centrally disposed within the drum 12 and supported along the central axis of the drum 120 by the hub 106. The trunk 220 includes the first end 222, which is closed, and the second end 224, which is open. The trunk 220 defines a cylinder having an internal space, wherein the cylinder includes a plurality of openings each of which is operatively connected to a branch 250. Each branch 250 is operatively connected to a duct 252 having an open end 254 and a closed end 256. A plurality of valves 258 are operatively connected to the duct 252, each valve 258 being located at the intersection of the respective branch 250 with the duct 252. A blower 260 is operatively connected to the end 254 and directs air towards the closed end 256. Each of the branches 250 includes a one or more of openings, slots, or nozzles, 262 with each opening being associated with one of the valves 258. Cooler air located externally to the drum 12 is moved by the blower 260 through the open end 254 and through the slots 262 to decrease the temperatures in the longitudinal and circumferential zones, where the appropriate zone is selected by the location and position of the valves 262.

Each of the valves 258 is operatively connected to the controller 80 which controls not only the position of the valve, but also the amount of time the valve is in an open and a closed position. In this way, not only can a longitudinal zone be selected for cooling but a portion of the longitudinal zone, the circumferential zone, can also be cooled. By blowing air through the duct 252, air flow is directed from the slots 262 to cool the selected longitudinal zone or the selected circumferential zone. High speed operation of the valves can provide cooling of relatively small circumferential zones on high speed drums. The respective valves 262 at the interface of the duct 254 and the branch 250 enable cooling air flow to impinge on the drum surface at the selected longitudinal and circumferential zones. The trunk 220 directs air flow out of the drum from the opening 224 after passing over the drum surface. In another embodiment, effective cooling can be achieved by the use of impinging high speed air knives to replace one or more of the openings 262. The blower 260 supplies a high pressure air flow through the duct 252.

In each of the described embodiments, the controller 80 can be configured to determine the amount of ink required to complete a print image prior to and during the deposition of the ink. By using the sensed temperatures and the determined amount of ink, the controller 80 can be configured to provide predictions of drum temperatures based on image density and placement of ink within a print job.

The controller 80 can use the prediction drum temperatures to add or to reduce the amount heat applied to the image drum. This information can also be used to supplement or to replace temperature data supplied by the temperature sensors. Segmented temperature sensing, heating, and/or cooling enables application of drum heating to only those zones of the drum surface that receive ink during printing. Faster imaging times and more frequent return to a low energy mode can be achieved. Machine energy consumption can thereby be reduced. In other embodiments, initial partial drum heating can be followed by full drum heating for normal printing.

As described herein, heating elements, temperature sensors, and directed cooling air flows are distributed axially along the length of the solid ink jet image drum. The axial distribution of heating, temperature sensing, and cooling components enables targeted control of drum surface temperatures in longitudinal bands around the drum. By the use of temperature sensors, including those having fast response times, heating element shutters, and cooling air flow values, control of drum surface temperatures can also be extended to circumferential zones within the longitudinal bands. Control of drum surface temperature in both longitudinal and circumferential zones can eliminate the temperature differences generated by localized high ink densities over long print runs. Consequently, the described embodiments and the application of the teachings described herein can reduce or prevent image quality defects in printers capable of printing upon media of different sizes, including A3 and A4 sizes, and in those printers having larger diameter production image drums.

To provide a more precise control of temperature uniformity across the entire surface of the image drum, the heating, cooling and temperature measurement functions are distributed axially along the drum surface. Fast response temperature sensors are distributed along the length of the drum either externally (non-contact) or internally (contact or non-contact). Short heater elements are distributed along the internal length of the drum to provide longitudinal heating segmentation. Reflective shutters are moved between the heater elements and the drum to inhibit heat transfer to the drum and provide circumferential heating segmentation. The cooling function is segmented by the use of small fans in large drums and a cooling air flow manifold with fast acting zone valves for smaller drums. The system is capable of sensing temperature in both longitudinal and circumferential regions of the drum surface and then directing both heat or cooling air flow to the individual regions to maintain a uniform drum surface temperature.

It will be appreciated that several of the above-disclosed and other features, and functions, or alternatives thereof, can be desirably combined into many other different systems or applications. As described herein, a system of heating, cooling and temperature sensing can control drum surface temperature more uniformly and independently of the images being printed. By sensing drum temperature at multiple locations along the length of the drum, not just at the ends, by applying heat with individually controllable heater units, and by segmenting and distributing cooling air flow distributed to those regions of the drum that have excess heat, indirect inkjet printing can be improved. By segmenting the temperature sensing, heating and cooling functions, machine power used for heating and cooling the drum can be used more efficiently. Partial drum heating in the areas of image content of the first prints enable faster warm-up to a print ready state and therefore more frequent lapses into low energy mode without long waits for machine warm-up. Better longitudinal and circumferential control of image drum temperature can also enable faster print speeds for solid ink jet printers. Various presently unforeseen or unanticipated alternatives, modifications, variations, or improvements therein can be subsequently made by those skilled in the art, which are also intended to be encompassed by the following claims.

What is claimed is:

1. A heated drum assembly for use in a printer, the heated drum assembly comprising:

a hollow drum including an external surface and an internal surface defining an internal cavity, the hollow drum having a first end, a second end, and a longitudinal axis;

a heater located in the internal cavity, the heater including three or more heating units, each of the heating units being individually controllable to heat three or more zones defined on the external surface of the hollow drum along a longitudinal axis of the hollow drum selectively, each of the heating units having one or more heating elements operatively connected to generate heat simultaneously, a reflector and an aperture, the reflector being configured to reflect heat through the aperture to heat the internal surface of the hollow drum;

an external non-contacting temperature sensor spaced from the external surface of the hollow drum; and an internal temperature sensor disposed in the internal cavity and in either a contacting position or non-contacting position with respect to the internal surface of the hollow drum; and a controller operatively connected to the heater, the controller being configured to regulate an amount of heat generated by each of the three or more heating units of the heater.

2. The heated drum assembly of claim 1 further comprising:

a plurality of covers, each cover in the plurality of covers being operatively associated with one of the reflectors in the heating units and each cover in the plurality of covers being configured to move to a first position to open the aperture and to a second position to close the aperture.

3. The heated drum assembly of claim 2, the heater further comprising:

a first row of heating units; and a second row of covers, each cover in the second row being configured to be positioned to expose an adjacent heating unit in the first row to the internal surface of the drum and to be positioned to cover the adjacent heating unit in the first row.

4. The heated drum assembly of claim 3, the first row of heaters further comprising:

at least one cover; and the second row of covers further comprising:

at least one heating unit, the at least one cover in the first row being configured to be positioned to cover the at least one heating unit in the second row and to be positioned to expose the at least one heating unit in the second row.

5. The heated drum assembly of claim 4 wherein the at least one cover is interposed between two heating units in the first row.

6. The heated drum assembly of claim 5 wherein the at least one heater is interposed between two covers in the second row.

7. The heated drum assembly of claim 3 further comprising:

a plurality of external non-contacting temperature sensors spaced from the external surface of the hollow drum; and a plurality of internal temperature sensors disposed in the internal cavity in either a contacting position or a contacting position, one of the external temperature sensors and one of the internal temperature sensors is operatively associated with one of the heater units.

8. The heated drum assembly of claim 1 further comprising:

a distributed cooling system disposed in the internal cavity, the distributed cooling system having at least three cooling zones.

9. The heated drum assembly of claim 8, the distributed cooling system further comprising:

an air flow directing device that is configured to direct air flow to each one of the cooling zones in the distributed cooling system individually.

10. The heated drum assembly of claim 9, the air flow directing device further comprising:

a plurality of fans, each fan in the plurality of fans being associated with one of the cooling zones in the distributed cooling system.

11. The heated drum assembly of claim 9, the air flow directing device further comprising:

a plurality of valves, each valve in the plurality of valves being associated with one of the cooling zones in the distributed cooling system.

12. The heated drum assembly of claim 9, the air flow directing device further comprising:

a conduit having a plurality of openings, each opening in the plurality of openings being associated with one of the cooling zones in the distributed cooling system.

13. The heated drum assembly of claim 12 further comprising:

a plurality of valves, each valve in the plurality of valves being operatively connected to one openings in the plurality of openings in the conduit.

* * * * *